US006216271B1

(12) United States Patent
Chen

(10) Patent No.: US 6,216,271 B1
(45) Date of Patent: Apr. 17, 2001

(54) GARMENT FOR A PATIENT

(76) Inventor: Chi-Yuen Chen, 7th Fl., No. 504 Yuan-Shan Rd, Chungho City, Taipei Hsien (TW)

( * ) Notice: Subject to any disclaimer, the term of this patent is extended or adjusted under 35 U.S.C. 154(b) by 0 days.

(21) Appl. No.: 09/593,758

(22) Filed: Jun. 14, 2000

(51) Int. Cl.[7] ..... A41B 1/00
(52) U.S. Cl. ..... 2/69; 2/114
(58) Field of Search ..... 2/69, 114, 113, 2/115, 80, 83, 85, 94, 93, 95, 108, 105, 106

(56) References Cited

U.S. PATENT DOCUMENTS 2,686,914 * 8/1954 Weiser .
3,259,913 * 7/1966 Tames .
4,422,186 * 12/1983 Loney ..... 2/114
4,434,511 * 3/1984 Weiser ..... 2/114
4,969,215 * 11/1990 Burkett ..... 2/114
5,062,159 * 11/1991 Jakub ..... 2/114
5,150,477 * 9/1992 Elberson et al. ..... 2/114
5,414,867 * 5/1995 Bowling et al. ..... 2/51
5,444,872 * 8/1995 Johnson ..... 2/114
5,564,123 * 10/1996 Grassick ..... 2/69
5,611,087 * 3/1997 Adkins ..... 2/114
6,012,166 * 1/2000 Burbidge ..... 2/83

* cited by examiner

*Primary Examiner*—Gloria M. Hale
(74) *Attorney, Agent, or Firm*—Rosenberg, Klein & Lee

(57) ABSTRACT

A garment for a hospital patient is disclosed. The garment has a front piece with a first side, a first shoulder, a second side and a second shoulder, and a back piece with a first edge and a second edge. The first edge of the back piece is sewn to the front piece at a first side and a first shoulder thereof. A plurality of fastening means in pairs is provided at a second side and a second shoulder, and the second edge. Two sleeves are respectively formed at the first and second shoulders. The sleeve at the first shoulder is sewn with the first edge of the second piece. The sleeve at the second side is sewn only with the front piece. An extending part is formed on the front piece and extends backwards from the second shoulder.

4 Claims, 5 Drawing Sheets

GARMENT FOR A PATIENT

BACKGROUND OF THE INVENTION

1. Field of the Invention

The present invention is related to a garment, and more particularly to a garment designed for patients in a hospital, etc.

2. Description of Related Art

In hospital, patients must wear a garment specially designed for them. The conventional patient's garment has a front placket formed on a front part thereof. A plurality of buttons is formed at a first side of the front placket and a plurality of button holes corresponding to the buttons is defined at a second side of the front placket. The garment is put on from the patient's back and then fastened at the patient's front. Thus, the patient must get up from a bed in order to put on or take off the garment, and it may be difficult and even painful for some patients, especially those with back injuries. Furthermore, when a doctor wants to take a patient's temperature by inserting a thermometer in an armpit, some of the buttons must be unfastened which is inconvenient.

Another conventional patient's garment is designed to allow physical examination of the patient. The garment has a back placket formed at a back part thereof and cords respectively provided at two sides of the back placket. The garment is first put on from the front of the patient's body and then fastened at the patient's back by tying the cords. However, the patient's back is not completely covered by the garment whereby discomfort as well as embarrassment may be experienced. Moreover, it is also inconvenient for the hospital staff that the cords must be untied when the patient's temperature has to be taken.

Therefore, it is an objective of the invention to provide a convenient garment for hospital patients to mitigate and/or obviate the aforementioned problems.

SUMMARY OF THE INVENTION

The main objective of the invention is to provide a garment for a hospital patient which can be easily put on, and worn comfortably and conveniently.

Another objective of the invention is to provide a garment for a hospital patient which enables the patient's temperature to be conveniently taken.

Other objects, advantages and novel features of the invention will become more apparent from the following detailed description when taken in conjunction with the accompanying drawings.

DETAILED DESCRIPTION OF THE PREFERRED EMBODIMENT

Figure 1:
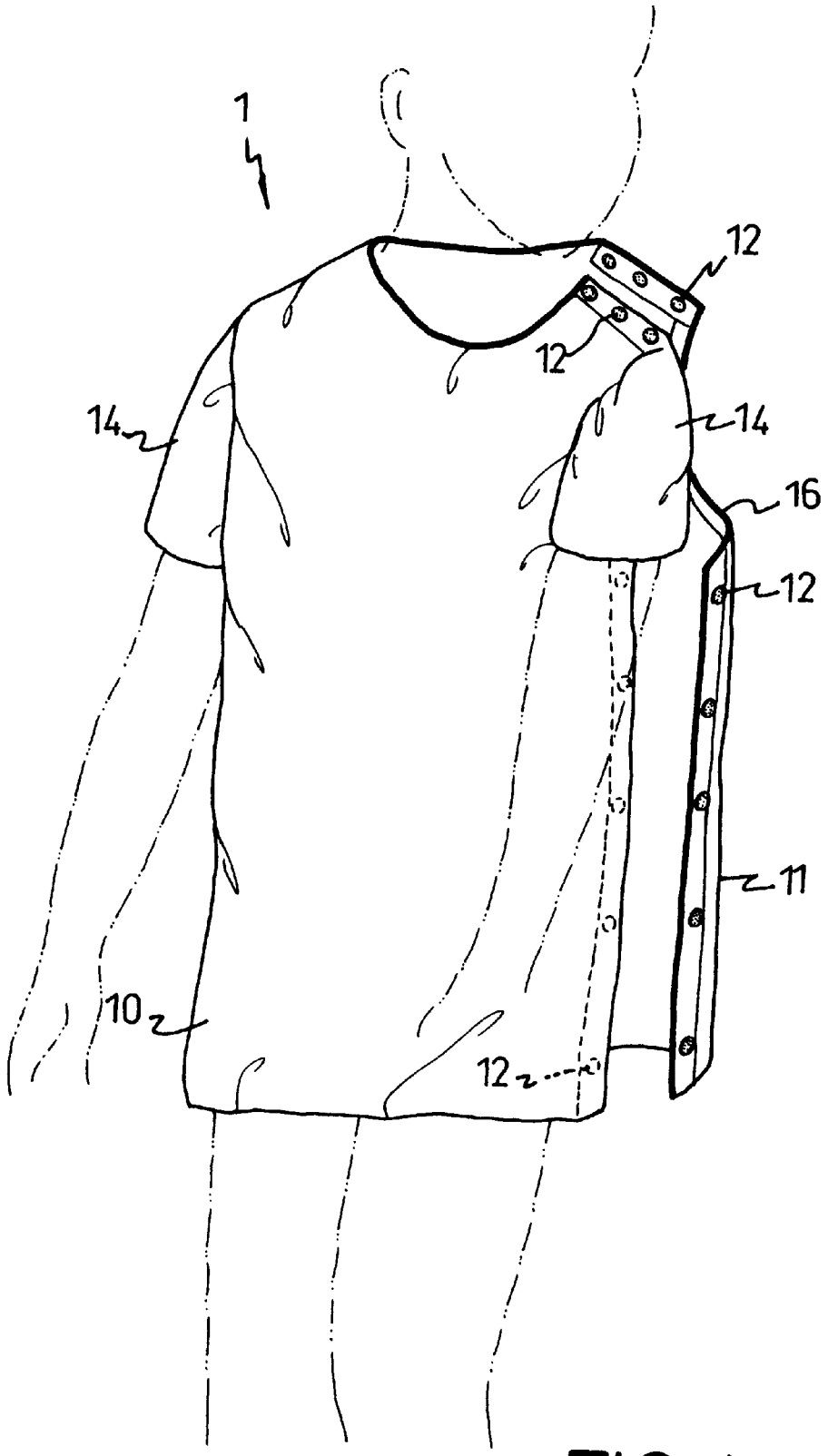
FIG. 1 is a front perspective view of a garment for a hospital patient in accordance with the invention.
Figure 2:
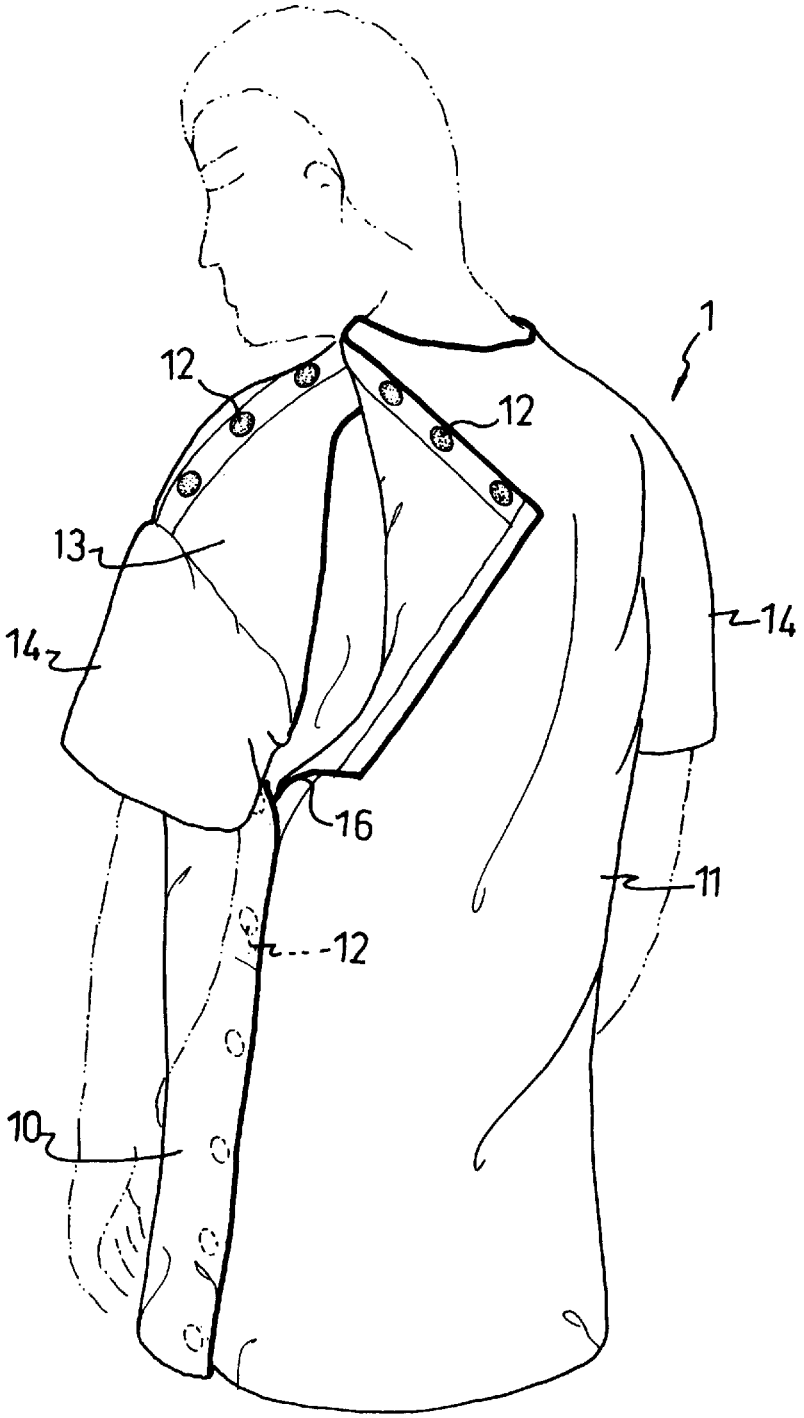
FIG. 2 is a back perspective view of the garment.

Referring to FIGS. 1 and 2, a garment (1) for a hospital patient in accordance with the present invention comprises a front piece (10) and a back piece (11) sewn to the front piece (10). The front piece (10) has a first side, a first shoulder, a second side, and a second shoulder. The back piece (11) has a first edge and a second edge. The first edge is sewn to the first side and first shoulder. A plurality of fastening means (12), such as Velcro tapes, buttons, or snaps, is in pairs provided on the second side of the front piece (10) and the second edge of the back piece (11). The garment (1) further comprises two sleeves (14), wherein a first of the sleeves (14) is formed on the first side and shoulder of the front piece (10) and the first edge of the second piece (11), and the second sleeve (14) is formed on the second side and shoulder of the front piece (10) and sewn with an extending part (13) which is formed on the front piece (10) and extends backwards from the second shoulder. The sleeve (14) at the second shoulder and second side has a notch (16) defining an armpit to facilitate taking a patient's temperature. Although the sleeves (14) shown in these figures are short sleeves, long sleeves are equally possible.

Figure 3:
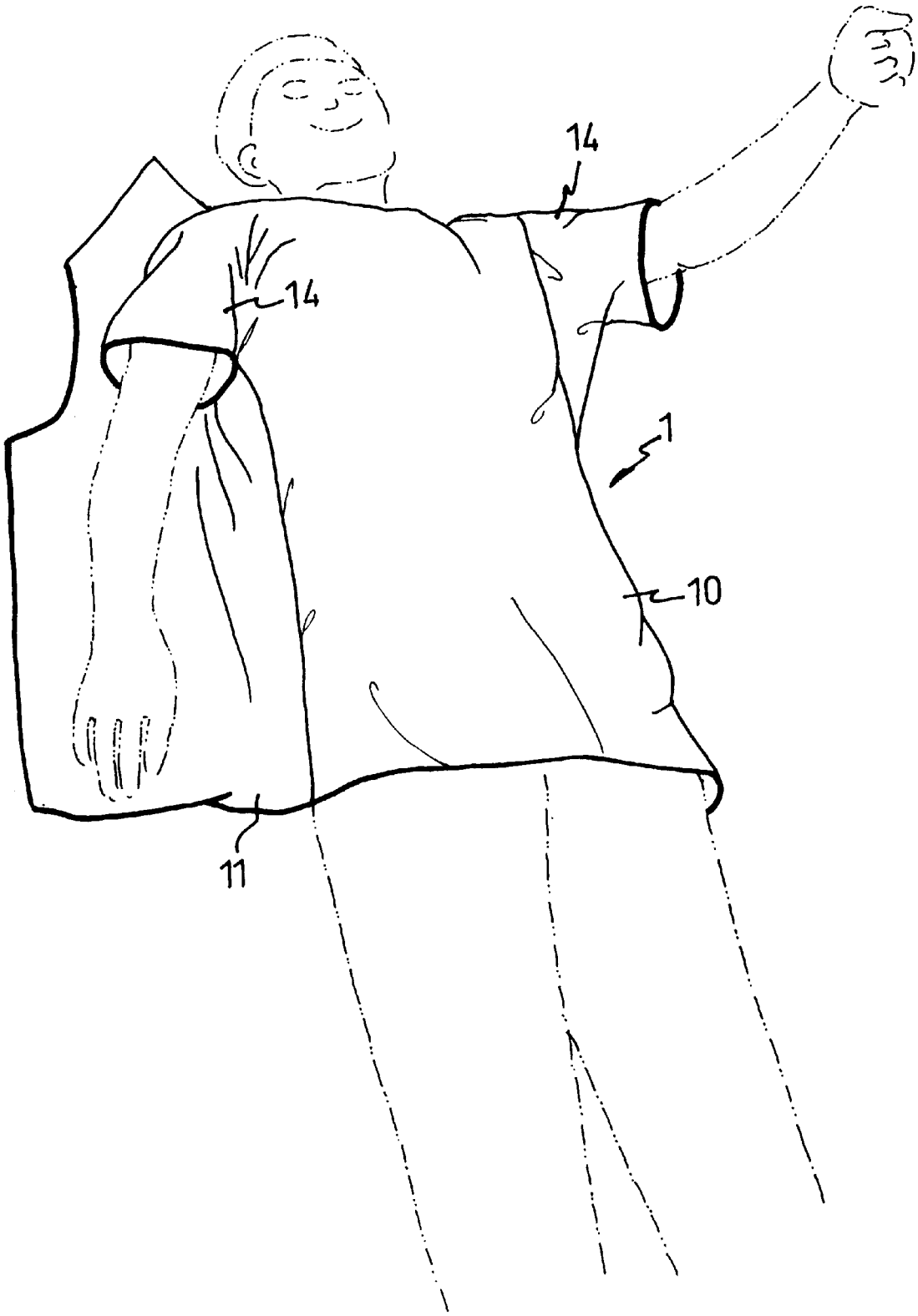
FIG. 3 is a schematic view showing a first step of putting on the garment.
Figure 4:
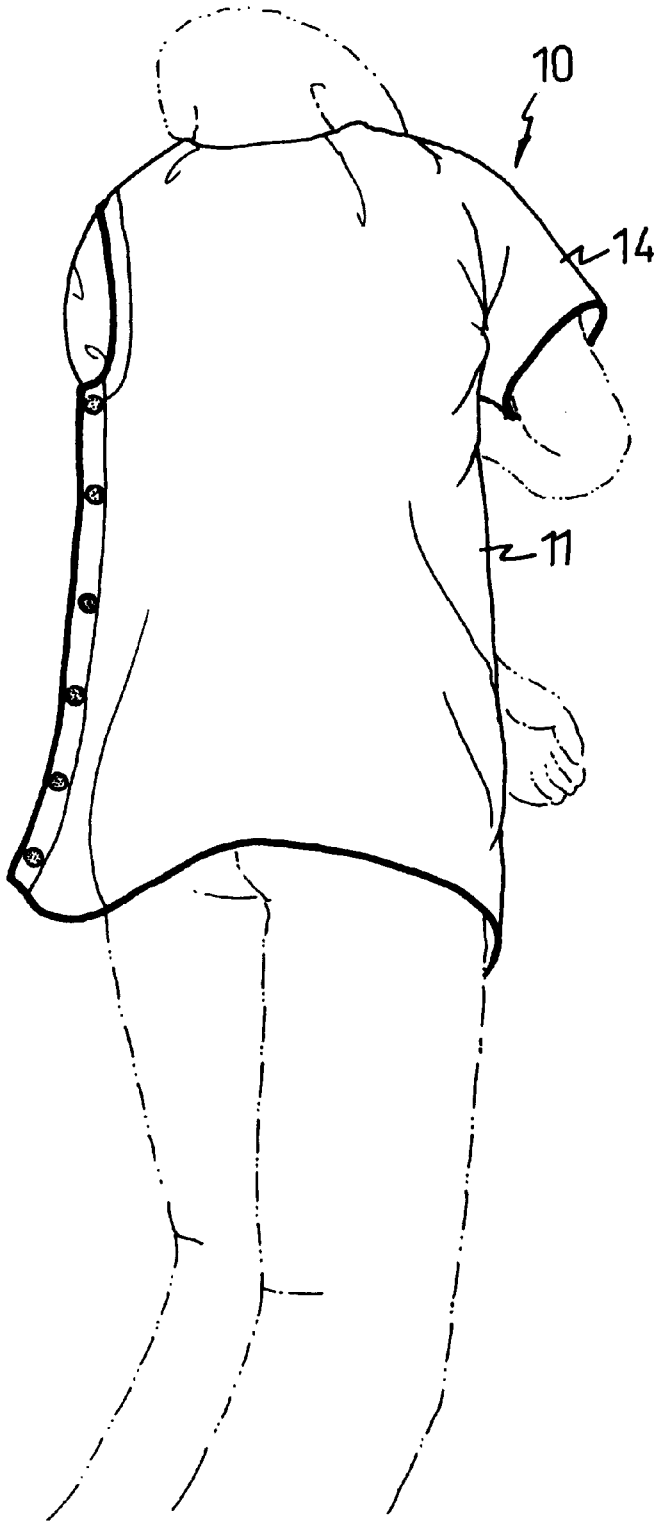
FIG. 4 is a schematic view showing a second step of putting on the garment.
Figure 5:
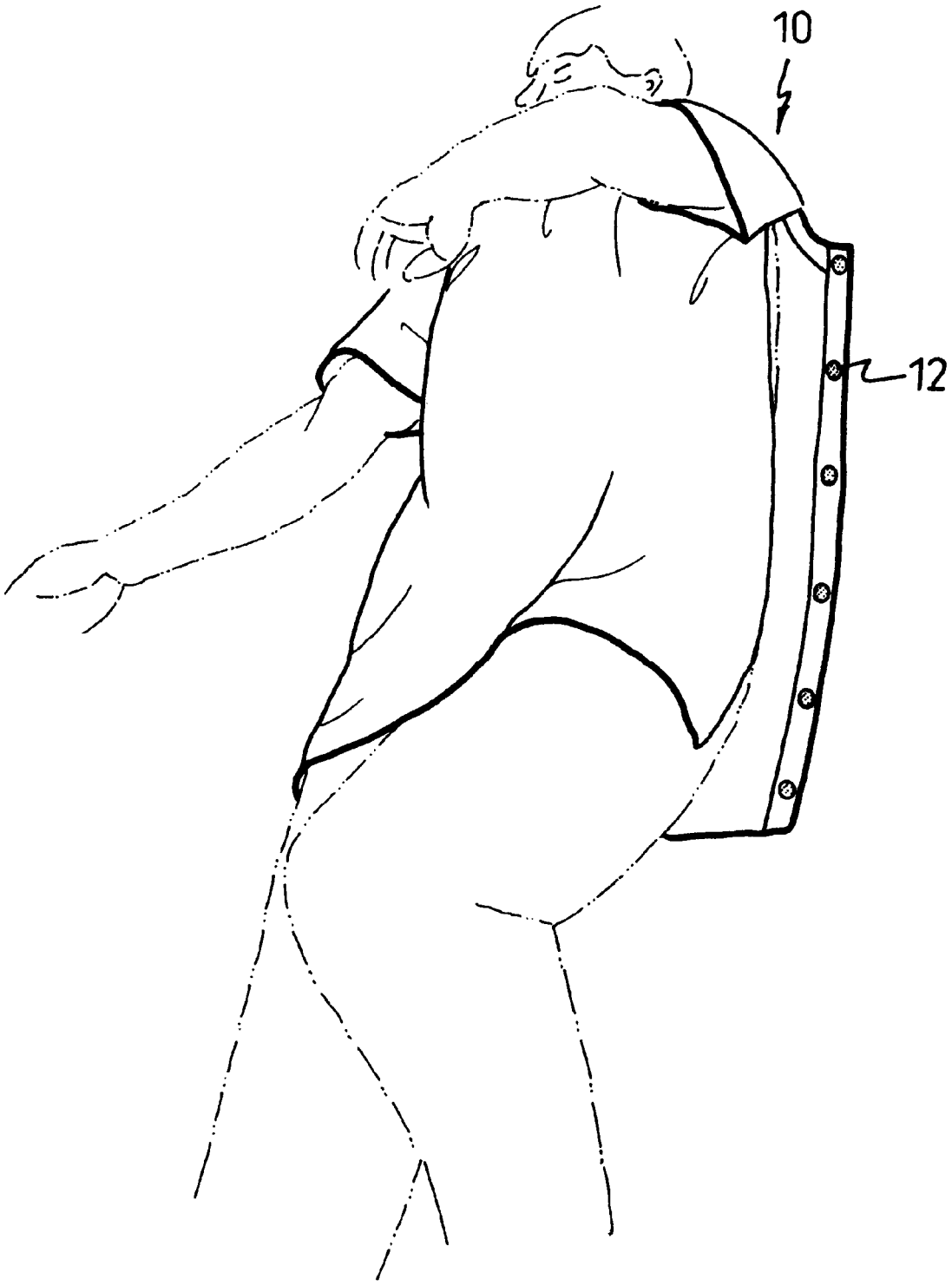
FIG. 5 is a schematic view showing a third step of putting on the garment.

To put on the garment (1), the front piece (10) is first put on a patient's front body with two arms of the patient respectively being inserted through the sleeves (14), as shown in FIG. 3. Afterwards, the patient turns over and the back piece (11) is put on the patient's back, as shown in FIG. 4. Finally, the patient turns back and the fastening means (12) are engaged together to fasten the garment (1).

The garment (1) mentioned hereinbefore and shown in the accompanying figures is in a jacket form. However, the garment shaped as a gown form also falls within the extent of the invention.

From the above description, it is noted that the invention has the following advantages:

1. Because the garment is designed to fasten at a side, a patient puts it on or takes it off by only be turning over once and without getting up, which is very convenient for the patient and will minimize possible aggravation of any pain the patient may have.
2. Because the garment can completely cover the front and back of the patient's body, the patient will not feel discomfort or embarrassment because of the garment during a physical examination.
3. The notch defined at an armpit of the dress is convenient for a doctor to take the patient's temperature.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A garment for a patient comprising:

a front piece (10) having a first side and first shoulder, and a second side and a second shoulder;

a back piece (11) having a first edge and a second edge, and sewn at the first edge thereof to the front piece (10) at the first side and the first shoulder of the front piece;

a plurality of fastening means (12) in pairs provided at the second side and the second shoulder of the front piece (10) and the second edge of the back piece (11); and, two sleeves (14), a first of said sleeves formed at said first side and shoulder, and sewn to said first edge, and a second of said sleeves (14) formed at said second side and shoulder, and an extending part (13) which is formed on said front piece (10) and extends backwards from said second shoulder.

2. The garment as claimed in claim 1, wherein said sleeves (14) are short sleeves.

3. The garment as claimed in claim 1, wherein said sleeves (14) are long sleeves.

4. The garment as claimed in claim 1, wherein said sleeve (14) at the second side has a notch (16) defined at an armpit.

* * * * *